US009806483B2

(12) United States Patent
Ledgerwood et al.

(10) Patent No.: US 9,806,483 B2
(45) Date of Patent: Oct. 31, 2017

(54) CONNECTOR INSTALLATION TOOL

(71) Applicants: Adam D. Ledgerwood, Penn Yan, NY (US); Timothy Daly, Syracuse, NY (US)

(72) Inventors: Adam D. Ledgerwood, Penn Yan, NY (US); Timothy Daly, Syracuse, NY (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/065,450

(22) Filed: Mar. 9, 2016

(65) Prior Publication Data

US 2016/0190761 A1 Jun. 30, 2016

Related U.S. Application Data

(62) Division of application No. 13/950,863, filed on Jul. 25, 2013, now abandoned.

(51) Int. Cl.

| | |
|---|---|
| ***B23P 19/00*** | (2006.01) |
| ***H01R 43/20*** | (2006.01) |
| ***H01R 43/26*** | (2006.01) |

(52) U.S. Cl.

CPC ..... *H01R 43/26* (2013.01); *Y10T 29/49195* (2015.01); *Y10T 29/53209* (2015.01); *Y10T 29/53222* (2015.01)

(58) Field of Classification Search

CPC ..... Y10T 137/598; Y10T 29/53209; Y10T 137/79; H01R 43/26; H01R 13/629

USPC ..... 29/747, 237, 255, 275, 280, 450, 729, 29/748, 750, 869; 439/133, 304, 306, 439/307, 308, 322, 583, 792

See application file for complete search history.

(56) References Cited

U.S. PATENT DOCUMENTS

| | | | | |
|---|---|---|---|---|
| 3,953,097 | A * | 4/1976 | Graham | H01R 9/05 439/307 |
| 6,817,272 | B2 | 11/2004 | Holland | |
| 7,021,947 | B1 * | 4/2006 | Purdy | H01R 13/6397 439/133 |
| 7,120,997 | B2 | 10/2006 | Islam et al. | |
| 7,318,272 | B1 | 1/2008 | Steiner | |
| 7,562,442 | B2 | 7/2009 | Montena | |
| 7,607,218 | B2 | 10/2009 | Montena et al. | |
| 7,703,196 | B2 | 4/2010 | Chawgo | |
| 7,823,271 | B2 | 11/2010 | Xie et al. | |
| 7,908,741 | B2 | 3/2011 | Chawgo | |
| 8,001,679 | B2 | 8/2011 | Youtsey | |
| 8,015,698 | B2 | 9/2011 | Sutter et al. | |
| 8,112,876 | B2 | 2/2012 | Xie et al. | |

(Continued)

*Primary Examiner* — Thiem Phan

(74) *Attorney, Agent, or Firm* — King & Spalding LLP

(57) ABSTRACT

A connector installation tool can include an inner surface having a first portion having a first perimeter, where the inner surface forms a cavity that traverses a first length of the inner surface. The connector installation tool can also include an opening having a width and traversing a second length of the outer surface and the first length of the inner surface. The connector installation tool can further include a front face located adjacent to and substantially perpendicular to the first portion of the inner surface. The connector installation tool can also include a rear face located adjacent to a distal end of the inner surface, where the rear face is substantially parallel to the front face.

9 Claims, 5 Drawing Sheets

(56) References Cited

U.S. PATENT DOCUMENTS

| | | | |
|---|---|---|---|
| 8,112,877 | B2 | 2/2012 | Xie et al. |
| 8,132,323 | B2 | 3/2012 | Rodrigues |
| 8,256,102 | B2 | 9/2012 | Sutter et al. |
| 8,272,128 | B2 | 9/2012 | Chawgo et al. |
| 8,296,935 | B2 | 10/2012 | Montena |
| 8,307,544 | B2 | 11/2012 | Natoli et al. |
| 8,356,402 | B2 | 1/2013 | Xie et al. |
| 2006/0191132 | A1 | 8/2006 | Montena |
| 2012/0222295 | A1 | 9/2012 | Chawgo |
| 2012/0222297 | A1 | 9/2012 | Chawgo |
| 2012/0222300 | A1 | 9/2012 | Chawgo |

* cited by examiner

CONNECTOR INSTALLATION TOOL

RELATED APPLICATION

This application is a divisional application of and claims priority to U.S. patent application Ser. No. 13/950,863, entitled "Connector Installation Tool" and filed on Jul. 25, 2013, and which is incorporated herein by reference in its entirety.

TECHNICAL FIELD

Embodiments described herein relate generally to connectors, and more particularly to systems, methods, and devices for connecting and disconnecting electrical connectors.

BACKGROUND

Electrical connectors, as well as some other types (e.g., mechanical) of connectors, often include a male end and a female end that mechanically couple to each other. In the case of electrical connectors, coupling the male and female ends to each other also creates an electrical connection. These electrical connectors can have a number of varying characteristics. For example, some electrical connectors include only a single pin, while other electrical connectors include over 150 pins, where each pin represents an electrical path for a signal and/or power. As another example, some electrical connectors are somewhat large, while other electrical connectors are small. These characteristics (e.g., number of pins, size) can make manual coupling and decoupling of the male and female portions of an electrical connector a difficult task.

In cases where the manual coupling and decoupling of the male and female portions of an electrical connector are cumbersome, damage can occur to the electrical connector, making the electrical connector inoperable. For example, a pin can break, or a wire connected to a pin can become dislodged. Such damage can be based on one or more of a number of reasons. For example, damage can occur from improperly aligning the male and female end when applying a force to couple or decouple those ends. As another example, damage can occur when there are a large number of wires and some get dislodged from their pin connections in order to properly align the male and female portions.

SUMMARY

In general, in one aspect, the disclosure relates to a connector installation tool. The connector installation tool can include an inner surface having a first portion having a first perimeter, where the inner surface forms a cavity that traverses a first length of the inner surface. The connector installation tool can also include an opening having a width and traversing the first length of the inner surface. The connector installation tool can further include a front face located adjacent to and substantially perpendicular to the first portion of the inner surface. The connector installation tool can also include a rear face located adjacent to a distal end of the inner surface, where the rear face is substantially parallel to the front face.

In another aspect, the disclosure can generally relate to a system for assembling an electrical connector. The system can include a first connector end of the connector having a first coupling feature, a first protrusion on its outer surface, and at least one first wire receiver. The system can also include a second connector end of the connector having a second coupling feature, a second protrusion on its outer surface, and at least one second wire receiver, where the second coupling feature mechanically couples to the first coupling feature. The system can further include a connector installation tool coupled to the first connector end. The connector installation tool of the system can include a first inner surface having a first portion having a first perimeter, where the first inner surface forms a cavity that traverses a first length of the first inner surface, and where the first perimeter is substantially the same as a first connector perimeter on a first outer surface of the first connector end. The connector installation tool of the system can also include a first opening having a first width and traversing the first length of the first inner surface. The connector installation tool of the system can further include a first front face located adjacent to and substantially perpendicular to the first portion of the first inner surface, where the first front face abuts against the first protrusion of the first connector end. The connector installation tool of the system can also include a first rear face located adjacent to a distal end of the first inner surface, where the first rear face is substantially parallel to the first front face. The system can also include a compression device that receives the second connector end and the first connector end coupled to the connector installation tool, where the compression device has a first position and a second position, where the first rear face abuts against one side of the compression device and the second connector end abuts against another side of the compression device. The first connector end and the second connector end can be decoupled when the compression device is in the first position. The first connector end and the second connector end can be coupled when the compression device is in the second position.

In yet another aspect, the disclosure can generally relate to a method for coupling two ends of a connector. The method can include receiving a portion of a first connector end of the connector into a cavity of a connector installation tool, where a different portion of the first connector end abuts against a front face of the connector installation tool. The method can also include positioning a second connector end of the connector proximate to the remainder of the first connector end to form an uncoupled connector assembly, where a first coupling feature of the first connector end is positioned proximately to a second coupling feature of the second connector end. The method can further include positioning the uncoupled connector assembly in a compression device, where the compression device is in an open position. The method can also include closing the compression device into a closed position to form a first coupled connector assembly, where closing the compression device couples the first coupling feature to the second coupling feature.

These and other aspects, objects, features, and embodiments will be apparent from the following description and the appended claims.

BRIEF DESCRIPTION OF THE DRAWINGS

The drawings illustrate only example embodiments of connector installation tools and are therefore not to be considered limiting of its scope, as connector installation tools may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
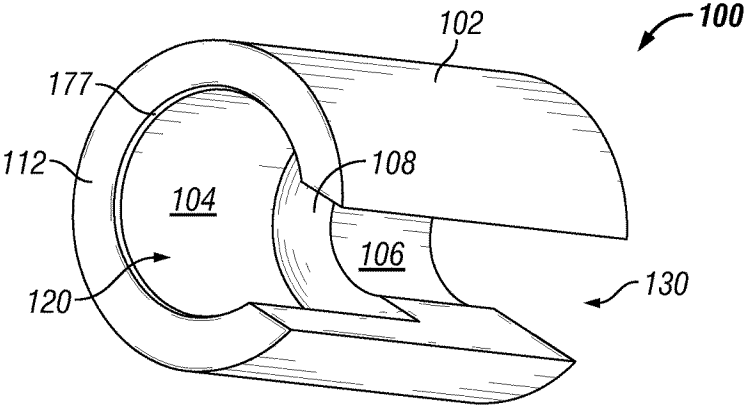
FIGS. 1A-1C show various views of an example connector installation tool in accordance with certain example embodiments.

The example embodiments discussed herein are directed to systems, apparatuses, and methods of connector installation tools. While the Figures shown and described herein are directed to electrical connectors, example connectors can be of other types, such as mechanical connectors. Thus, example connector installation tools described herein are not limited by the type of connector.

A user as described herein may be any person that is involved with installation and/or maintenance of connectors. Examples of a user may include, but are not limited to, a company representative, an electrician, an engineer, a mechanic, an operator, a consultant, a contractor, and a manufacturer's representative.

Example embodiments of connector installation tools will be described more fully hereinafter with reference to the accompanying drawings, in which example embodiments of connector installation tools are shown. Connector installation tools may, however, be embodied in many different forms and should not be construed as limited to the example embodiments set forth herein. Rather, these example embodiments are provided so that this disclosure will be thorough and complete, and will fully convey the scope of connector installation tools to those of ordinary skill in the art. Like, but not necessarily the same, elements (also sometimes called components) in the various figures are denoted by like reference numerals for consistency. Terms such as "first," "second," "distal," "proximal," "front," and "rear" are used merely to distinguish one component (or part of a component) from another. Such terms are not meant to denote a preference or a particular orientation.

Figure 1C:
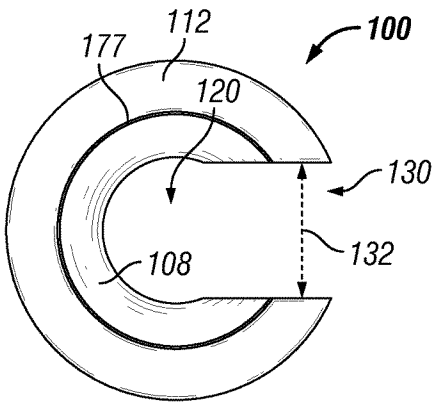
Figure 1B:
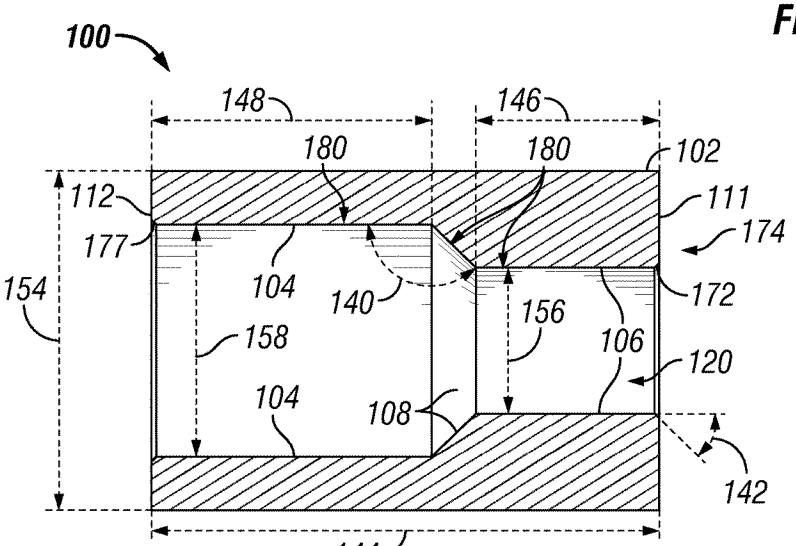

FIGS. 1A-1C show various views of an example connector installation tool 100 in accordance with certain example embodiments. In one or more embodiments, one or more of the components shown in FIGS. 1A-1C may be omitted, added, repeated, and/or substituted. Accordingly, embodiments of a connector installation tool should not be considered limited to the specific arrangements of components shown in FIGS. 1A-1C.

Referring to FIGS. 1A-1C, the connector installation tool 100 includes an outer surface 102 and an inner surface 180. The inner surface 180 forms a cavity 120 that traverses the length of the inner surface 180. In certain example embodiments, the inner surface 180 includes multiple portions. In this example, the inner surface 180 of the connector installation tool 100 has three portions: Portion 104, portion 106, and portion 108. The portions of the inner surface 180 can be concentric with the outer surface 102, as shown in FIGS. 1A-1C. In addition, or in the alternative, or one or more of the portions of the inner surface 180 can be eccentric relative to the other portions of the inner surface 180.

The size and/or shape of each portion of the inner surface 180 can vary based on one or more of a number of factors. Examples of such factors can include, but are not limited to, a size and/or shape of a portion of a connector, the number of wires that are coupled to a portion of the connector, and the size of the compression device. For example, the portion 104 and the portion 106, as shown in FIGS. 1A-1C, can each be cylindrical. In such a case, the portion 106 has a length 146 and a diameter 156, and the portion 104 has a length 148 and a diameter 158.

In one example embodiment, the length 146 can be approximately 27.9 centimeters (cm), the diameter 156 can be approximately 21.84 cm, the length 148 can be approximately 41.9 centimeters (cm), and the diameter 156 can be approximately 34.54 cm. In such a case, if the outer surface 102 is also cylindrical, the diameter 154 of the outer surface 102 can be approximately 49.5 cm or 54.1 cm, and the length 144 can be approximately 76.2 cm. The size (e.g., diameter 156) and the cylindrical shape of the portion 106 can be substantially the same as the size and shape of an outer portion of a connector end of a connector. Similarly, the size (e.g., diameter 154) and the cylindrical shape of the portion 104 can be substantially the same as the size and shape of an outer portion of a different connector end of a same or different connector.

In another example embodiment, when the portion 104, the portion 106, and the outer surface 102 are all cylindrically shaped, the length 146 can be approximately 27.9 centimeters (cm), the diameter 156 can be approximately 46.74 cm, the length 148 can be approximately 41.7 centimeters (cm), the diameter 156 can be approximately 59.94 cm, the diameter 154 can be approximately 74.9 cm or 79.5 cm, and the length 144 can be approximately 76.2 cm.

For these two example embodiments, the various lengths are substantially the same, but the diameters differ. However, other example embodiments of a tool and its various portions can have different lengths and/or diameters. Further, while the diameter 156 in these two example embodiments is smaller than the diameter 158, the diameter 156 can be larger than the diameter 158. Although the term "diameter" was used in these two example embodiments to describe the height or width of each portion of the inner surface 180, the term "perimeter" can more generally be used to describe the height or width of each portion of the inner surface 180, regardless of the cross-sectional shape of the inner surface 180.

The portion 108, in this example, is positioned between the portion 104 and the portion 106. The shape of portion 108 in FIGS. 1A-1C is conical, providing a transition between the portion 104 and the portion 106. The portion 108 can also have other shapes. In certain example embodiments, along the length of the portion 108, the diameter (again, the diameter can also be more generally called a perimeter) of the portion 108 can be more than the diameter 156 of the portion 106 and less than the diameter 154 of the portion 104. The various inner portions and/or the outer surface 102 can have one or more of a number of other shapes when viewed cross-sectionally, including but not limited to rectangular, square, oval, hexagonal, and triangular. The shape of the outer surface 102 can be the same or different than one or more of the portions of the inner surface.

In certain example embodiments, the connector installation tool 100 includes a front face 111 and a rear face 112. The front face 111 can be located adjacent to and substantially perpendicular to a proximal end of the inner surface 180. When the inner surface 180 includes multiple portions (e.g., portion 104, portion 106, portion 108), the front face 111 can be located adjacent to one of those portions. For example, in FIGS. 1A-1C, the front face 111 is located adjacent to and substantially perpendicular to the portion 106 of the inner surface 180.

Similarly, the rear face 112 can be located adjacent to and substantially perpendicular to a distal end of the inner surface 180, on an opposite end of the tool 100 from where the front face 111 is located. When the inner surface 180 includes multiple portions (e.g., portion 104, portion 106, portion 108), the rear face 112 can be located adjacent to one of those portions. For example, in FIGS. 1A-1C, the rear face 112 is located adjacent to and substantially perpendicular to the portion 104 of the inner surface 180. The front face 111 and the rear face 112 can have profiles that are substantially flat (as in FIGS. 1A-1C). Alternatively, the front face 111 and/or the rear face 112 can have one or more of a number of other profiles (e.g., saw-tooth, rounded), provided that such profiles can transmit a compressive force received from a compression device to at least one portion of a connector so that the compressive force is distributed substantially evenly across the portion of the connector.

In certain example embodiments, the connector installation tool 100 includes an opening 130 that traverses the length of the inner surface 180 and also the length 144 of the outer surface 102. The opening 130 can have a width 132 that is substantially uniform between the outer surface 102 and each portion, if multiple portions, of the inner surface 180. The width 132 of the opening 130 should be large enough to accommodate the number of wires that connect to an end of the connector.

The connector installation tool 100 can also include at least one beveled surface that is disposed on distal and/or proximal end of the connector installation tool 100. For example, as shown in FIG. 1B, a beveled surface 172 is disposed between the portion 106 of the inner surface 180 and the front face 111. As another example, as shown in FIG. 1B, a beveled surface 177 is disposed between the portion 104 of the inner surface 180 and the rear face 112.

A beveled surface (e.g., beveled surface 172) can form an acute angle (e.g., angle 142) between the beveled surface and the inner surface 180. The beveled surface can be used to help insert part of a connector into the cavity 120 formed by the inner surface 180. The length of a beveled surface can be relatively small, so that the vertical component 174 of the length is very small (e.g., 0.015 cm). In some cases, as shown and described below with respect to FIG. 2, the inner surface 180 of the connector installation tool 100 can include a fourth portion 207.

The connector installation tool 100 can be made from a single piece, as from a mold, or can be multiple pieces that are mechanically coupled to each other using one or more of a number of coupling devices and/or methods, including but not limited to soldering, compression fittings, slots, tabs, and mating threads. The connector installation tool 100 can be made of one or more of a number of materials that allow the connector installation tool 100 to substantially retain its shape (e.g., the perimeter of any portion of the inner surface does not increase substantially) when the front end 111 and the rear end 112 each have a lateral, inward force applied, as from a compression device. Examples of such materials can include, but are not limited to, metal and plastic.

Figure 2:
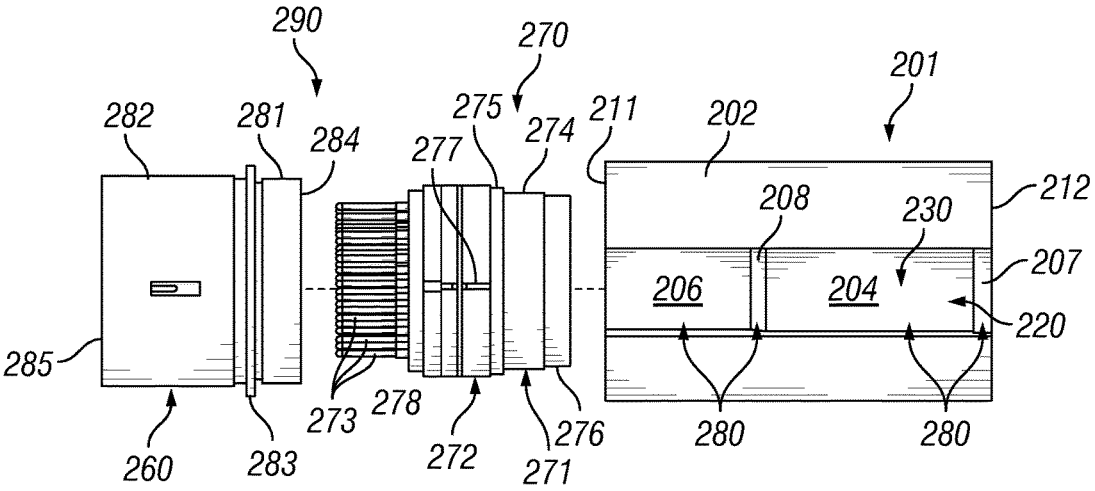
FIG. 2 shows an exploded view of a system for assembling an electrical connector using an example connector installation tool in accordance with certain example embodiments.

FIG. 2 shows an exploded view of a system 200 for assembling an electrical connector 290 using an example connector installation tool 201 in accordance with certain example embodiments. In one or more embodiments, one or more of the components shown in FIG. 2 may be omitted, added, repeated, and/or substituted. Accordingly, embodiments of a system for assembling an electrical connector using a connector installation tool should not be considered limited to the specific arrangements of components shown in FIG. 2.

Referring to FIGS. 1A-2, the system 200 can include a connector 290 and a connector installation tool 201. The connector can include a second end 260 and a first end 270. In such a case, the second end 260 and the first end 270 can be mechanically coupled to each other, which allows power to flow between the second end 260 and the first end 270. The second end 260 and the first end 270 can mechanically couple to each other using one or more of a number of coupling features. For example, as shown in FIG. 2, the second end 260 can include a number of pin receivers (hidden from view), which receive a number of pins 273 disposed on an end of the first end 270 of the connector 290.

In certain example embodiments, the second end 260 of the connector 290 includes one or more of a number of features. For example, as shown in FIG. 2, the second end 260 can include, aside from the coupling feature, an outer surface 282, a rear face 285, a front face 284, a collar 283, and a flange 281. As described below with respect to FIGS. 3A-4, one or more of these features can be used with the connector installation tool 201 to mechanically couple and/or decouple the second end 260 and the first end 270. The outer surface 282, the collar 283, and the flange 281 can be made from a single piece (as from a mold) or from multiple pieces that are mechanically coupled to each other. In any case, the outer surface 282, the collar 283, and the flange 281 can form a substantially rigid body that can withhold a compressive force applied between the front face 284 and the rear face 285.

Similarly, the first end 270 can include one or more of a number of features. For example, as shown in FIG. 2, the first end 270 can include a pressure sleeve 271, an insert 272, and the coupling feature 273. The pressure sleeve 271 can be fixedly or removably coupled to the insert 272. In certain example embodiments, the pressure sleeve 271 includes a body 274 and a collar 275, where the outer surface of the collar 275 has a perimeter that is larger than the perimeter of the outer surface of the body 274. In such a case, as described below with respect to FIGS. 3A and 3B, the collar 275 of the pressure sleeve 271 can be used to mechanically couple the second end 260 to the first end 270 using the connector installation tool 201.

The insert 272 can have a sleeve 276 over which the pressure sleeve 271 is disposed. Further, the insert 272 can include a collar 278 against which the pressure sleeve 271 abuts. The pressure sleeve 271 can include one or more features (not shown), such as a notch, to orient the pressure sleeve 271 with respect to the insert 272. Similarly, the insert 272 can include one or more features (e.g., slot 277 on the collar 278) to orient the insert 272 with respect to the pressure sleeve 271 and/or the second end 260.

In certain example embodiments, the shape and size of the outer surface of the pressure sleeve 271 (and in particular the body 274 of the pressure sleeve 271) are substantially the same as the shape and size (perimeter) of the portion 206 of the inner surface 280 of the tool 201. In such a case, the body 274 of the pressure sleeve 271 can be disposed within the cavity 220 of the inner surface 280 of the tool 201.

Figure 5:
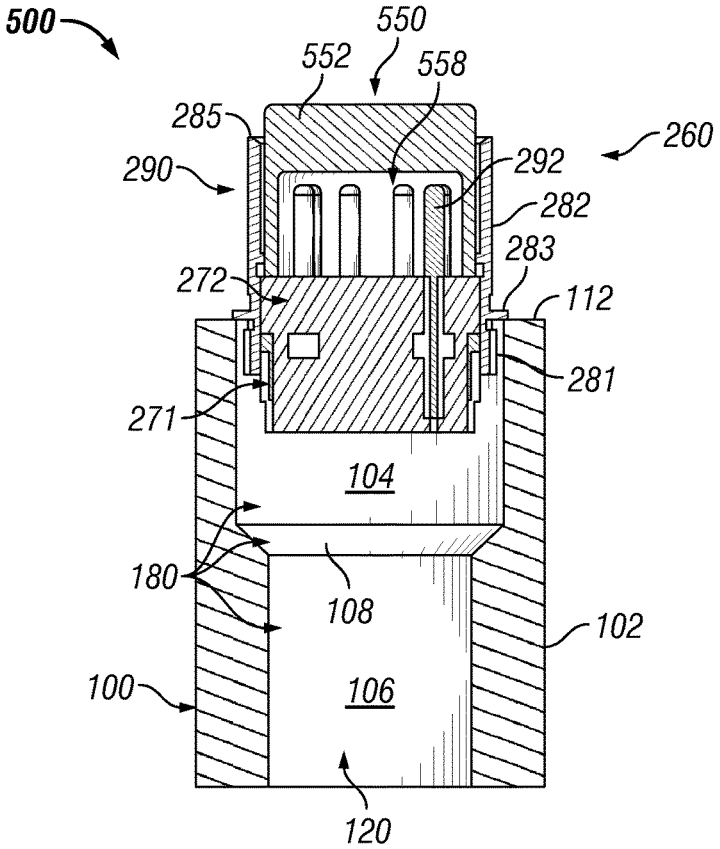
FIG. 5 shows a cross-sectional side view of a system for decoupling an electrical connector from an example connector installation tool in accordance with certain example embodiments.

In addition, the perimeter of the collar 275 of the pressure sleeve 271 can be larger than the perimeter of the portion 206 of the inner surface 280 of the tool 201, so that the collar 275 can abut against the front face 211 of the tool 201 and prevent the body 274 from sliding too far inside of the cavity 220 of the tool 201. As shown in FIG. 5 below, when wires are connected to the wire receivers of the first end 270 of the connector 290, the wires can extend through the opening 230 that traverses the length of the tool 201.

The tool 201 of FIG. 2 is substantially the same as the tool 100 of FIGS. 1A-1C, except that the tool 201 includes a fourth portion 207 of the inner surface 280. In this case, the portion 204 of the tool 201 is substantially the same as the portion 104 of the tool 100, except that the portion 204 does not extend to the rear face 212. Instead, portion 207 is adjacent to the rear face 212 and is positioned between the rear face 212 and the portion 204. The length of the portion 207 can be substantially less than the length of portion 204. In addition, or in the alternative, the portion 207 can have a perimeter that is larger than the perimeter of the portion 204 and portion 206.

Portion 207 can be included on the inner surface 280 to allow the tool 201 to fit more precisely over a portion of a connector to provide a better compressive force and/or to regulate how much insertion is permitted between the second end 260 and the first end 270 of the connector 290. Similarly, one or more other portions and/or features can be added to the inner surface of a tool to provide more efficient and less destructive coupling and decoupling forces to ends of a connector, and/or to prevent over-insertion and/or under-insertion of one connector end into another.

Figure 3A:
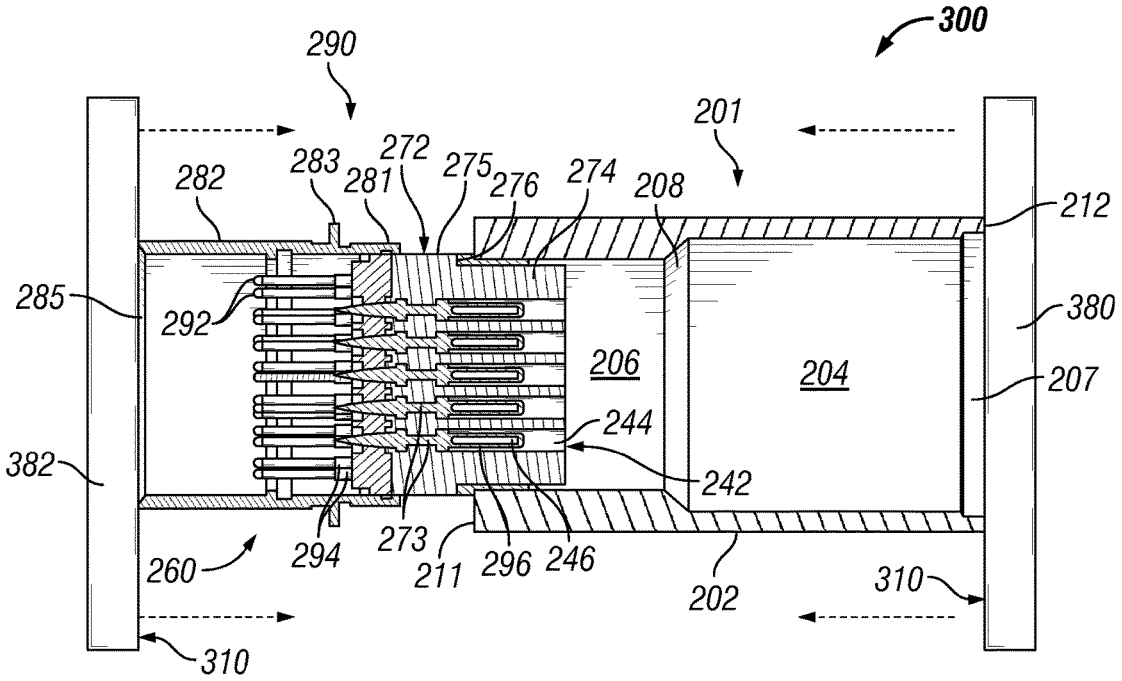
FIGS. 3A and 3B show cross-sectional side views of a system for assembling an electrical connector using an example connector installation tool in accordance with certain example embodiments.
Figure 3B:
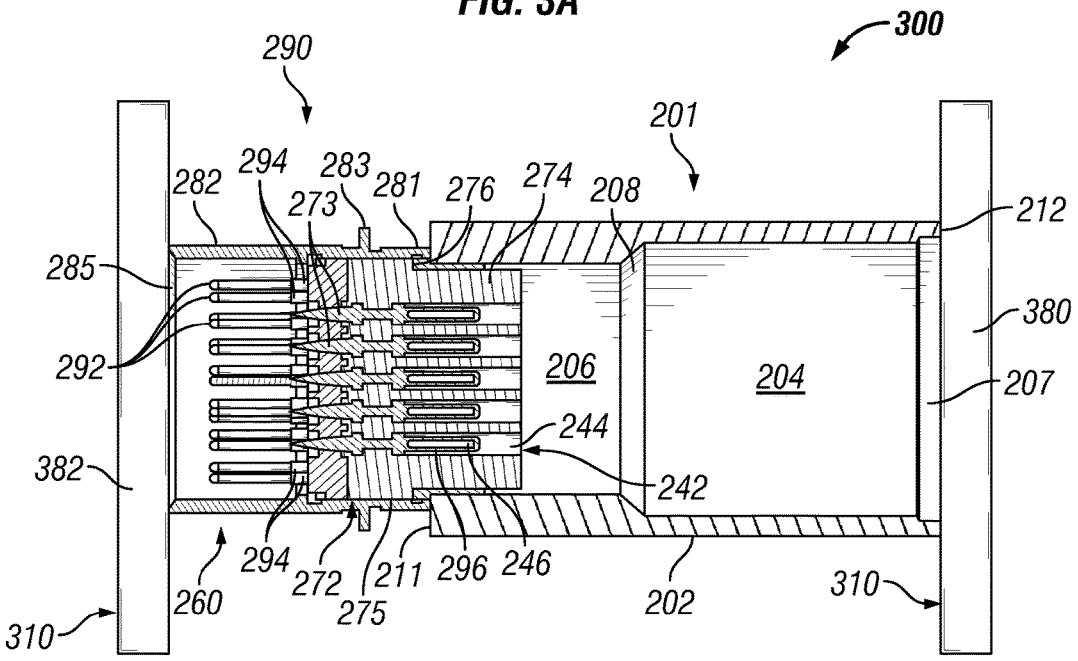

FIGS. 3A and 3B show cross-sectional side views of a system 300 for assembling the electrical connector 290 using the example connector installation tool 201 of FIG. 2 in accordance with certain example embodiments. In one or more embodiments, one or more of the components shown in FIGS. 3A and 3B may be omitted, added, repeated, and/or substituted. Accordingly, embodiments of a system for coupling (assembling) an electrical connector using a connector installation tool should not be considered limited to the specific arrangements of components shown in FIGS. 3A and 3B.

Referring to FIGS. 1A-3B, the system 300 of FIGS. 3A and 3B is substantially the same as the system 200 of FIG. 2, except as described below. The second end 260 includes one or more wire receivers 292 that are mechanically coupled to an equal number of coupling features 294. Similarly, the first end 270 includes one or more wire receivers 296 that are mechanically coupled to an equal number of coupling features 273. In certain example embodiments, the number of wire receivers 292 and coupling features 294 of the second end 260 equals the number of wire receivers 296 and coupling features 273 of the first end 270 of the connector 290.

The coupling features 294 of the first end can be configured to mechanically couple to, and also mechanically decouple from, the coupling features 273 of the first end 270. FIGS. 3A and 3B also show a distal end of a number of wires 242. Specifically, each wire 242 in FIGS. 3A and 3B show a bare conductor 246 at the far distal end where insulation 244 has been stripped away to allow the conductor 246 to mechanically couple to the wire receiver 296 of the first end 270 of the connector 290.

While FIGS. 3A and 3B do not show any wires that are inserted into and mechanically coupled to the wire receivers 292 of the second end 260, an additional connector installation tool, substantially similar to the connector installation tool 201 used with the first end 270, can be used with the second end 260. In such a case, one or more wires can be inserted into and mechanically coupled to the wire receivers 292 of the second end 260 before the coupling features 294 of the first end become mechanically coupled to the coupling features 273 of the first end 270.

In order to mechanically coupled the second end 260 and the first end 270 of the connector 290 together using the connector installation tool 201, a compressive force is applied to the rear face 285 of the second end 260, and an opposing compressive force is applied to the rear face 212 of the connector installation tool 201. The compressive forces can be applied by one or more of a number of compression devices. For example, as in this case, the compressive forces can be applied by a compression device 310 having a wall 380 and a wall 382. Examples of other compression devices can include, but are not limited to, a press, a compactor, and an adjustable clamp.

In FIG. 3A, the first end 270 of the connector is coupled to the connector installation tool 201, as described above with respect to FIG. 2. In addition, the front face 284 of the second end 260 of the connector 290 is aligned with, but not fully mechanically coupled to, the front face (represented by the connection feature 273) of the first end 270. All of these components (the connector installation tool 201, the second end 260 of the connector 290, and the first end 270 of the connector 290) are placed inside of the compression device 310 (in this case, between wall 380 and wall 382 of the vice 310). The compression device 310 can have an open position, where little or no compressive force is applied, and a closed position, where compressive forces are applied. The compression device 310 is shown in the open position in FIG. 3A.

In FIG. 3B, the compression device 310 is shown in the closed position, and so the compressive device 310 applies a compressive force to the components (the connector installation tool 201, the second end 260 of the connector 290, and the first end 270 of the connector 290) of FIG. 3A. As a result, the front face 211 of the tool 201 slides up against the lip 276 of the collar 275 of the pressure sleeve 271. When this occurs, and the compressive force continues to be applied, the first end 270 and the second end 260 are forced toward each other until the first end 270 and the second end 260 are fully mechanically coupled to each other (or, more specifically, until all of the coupling features 294 of the second end 260 are fully mechanically coupled to the corresponding coupling features 273 of the first end 270).

Applying too much compressive force to the second end 260 and the first end 270 of the connector 290 can result in damage to the coupling features 294 and/or the wire receivers 292 of the second end 260 and/or the coupling features 273 and/or the wire receivers 296 of the first end 270. To reduce the likelihood of this occurring, one or more features of the tool 201 can interact with one or more features of the connector 290. For example, as shown in FIG. 3B, the end of the flange 281 (corresponding to the front face 284 of the second end 260) can abut against the front face 211 of the tool 201 when the second end 260 and the first end 270 are fully mechanically coupled to each other. Because the flange 281, the collar 283, and the outer surface 282 are integrated into a single, rigid piece, the tool 201 cannot over-insert the first end 270 into the second end 260 when the flange 281 abuts against the front face 211 of the tool 201.

Since the compression device 310 applies inwardly-directed compression forces, the portions of the components (the connector installation tool 201, the second end 260 of the connector 290, and the first end 270 of the connector 290) should all be substantially aligned with the direction of the compression forces. If not, damage may occur to one or more portions of the connector 290. To help ensure that the components are substantially aligned with the direction of the compression forces, the rear face 212 and the front face 211 of the tool 201 can be substantially parallel to the wall 380, and the rear face 285 of the second end 260 can be substantially parallel to the wall 382. Put another way, the front face 211 and the rear face 212 can be substantially parallel to each other and substantially perpendicular to the portion 204 of the inner surface 280. Similarly, the rear face 285 and the front face 284 can be substantially parallel to each other and substantially perpendicular to the outer surface 282 of the second end 260.

The front face 211 and/or the rear face 212 can be flat. Alternatively, the front face 211 and/or the rear face 212 can be substantially a pointed edge based on a chamfered or beveled surface that transitions from the inner surface 280 to the front face 211 and/or the rear face 212. For example, the beveled surface 177 of the connector installation tool 100 in FIG. 1 could be much larger. Such a configuration could be used, for example, to better secure the pressure sleeve 271 or some other portion of the connector. As yet another alternative, the front face 211 and/or the rear face 212 can be rounded. Other shapes and configurations, other than those examples stated here, of the front face 211 and/or the rear face 212 can exist.

While the connector installation tool 201 can be used to fully mechanically couple the second end 260 and the first end 270 of the connector 290, as described above with respect to FIGS. 3A and 3B, the connector installation tool 201 can also be used to mechanically decouple the second end 260 and the first end 270 of the connector 290. By using the connector installation tool 201, the second end 260 and the first end 270 can be mechanically decoupled with a significantly decreased chance of damaging the coupling features, wires, and/or wire receivers of the second end 260 and the first end 270 of the connector 290.

Figure 4:
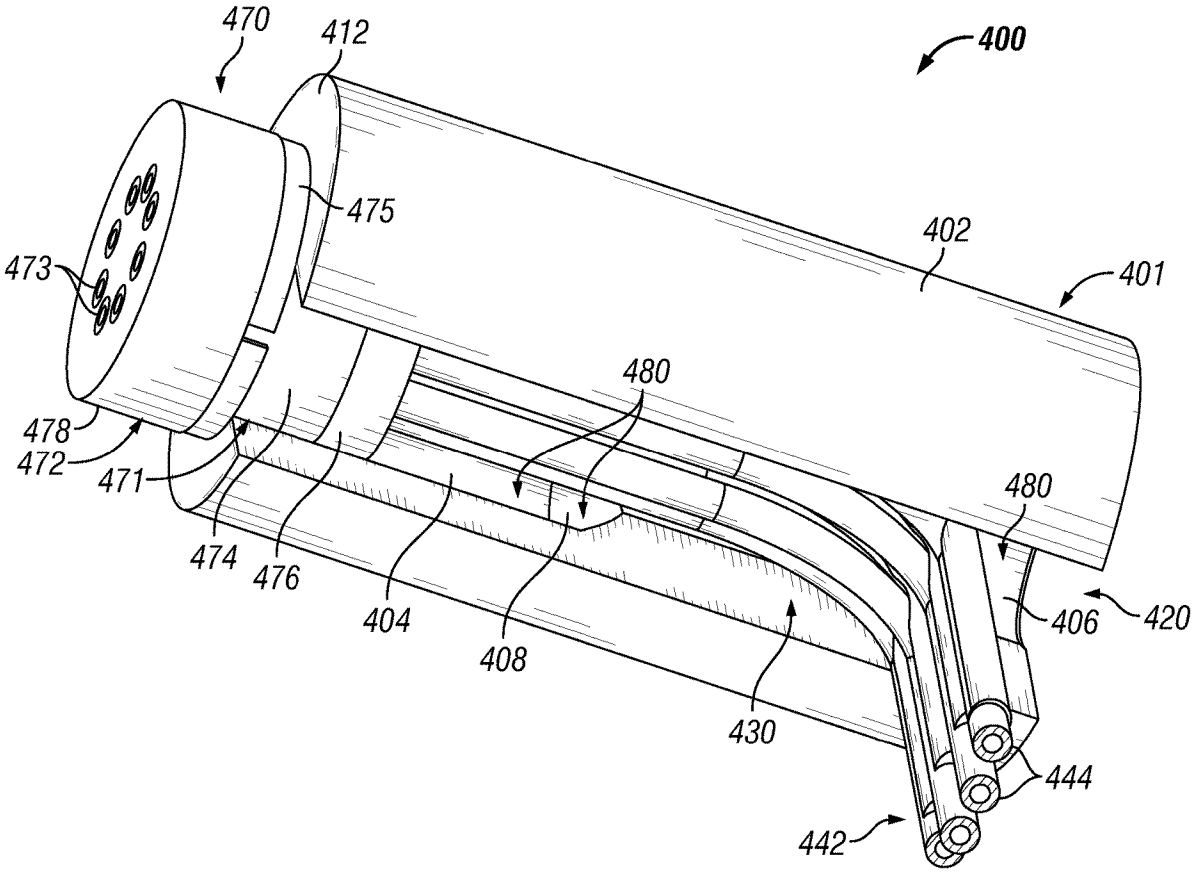
FIG. 4 shows a side perspective view of another system for assembling an electrical connector using an example connector installation tool in accordance with certain example embodiments.

FIG. 4 shows a side perspective view of another system 400 for assembling an electrical connector using an example connector installation tool 401 in accordance with certain example embodiments. In one or more embodiments, one or more of the components shown in FIG. 4 may be omitted, added, repeated, and/or substituted. Accordingly, embodiments of a system for assembling an electrical connector using a connector installation tool should not be considered limited to the specific arrangements of components shown in FIG. 4.

Referring to FIGS. 1A-4, the system 400 can include a connector installation tool 401 that has an outer surface 402 and an inner surface 480 that includes portion 404, portion 406, and portion 408. The rear face 412 is adjacent and substantially perpendicular to portion 404. The perimeter of the portion 404 is larger than the perimeter of the portion 406.

The connector end 470 of FIG. 4 includes a pressure sleeve 471, an insert 472, and a coupling feature 473. The pressure sleeve 471 includes a body 474 and a collar 475, where the outer surface of the collar 475 has a perimeter that is larger than the perimeter of the outer surface of the body 474. The insert 472 can have a sleeve 476 over which the pressure sleeve 471 is disposed. Further, the insert 472 can include a collar 478 against which the pressure sleeve 471 abuts.

In this example, the shape and size of the outer surface of the pressure sleeve 471 (and in particular the body 474 of the pressure sleeve 471) are substantially the same as the shape and size (perimeter) of the portion 404 of the inner surface 480 of the tool 401. In such a case, the body 474 of the pressure sleeve 471 can be disposed within the cavity 420 of the inner surface 480 of the tool 401. In addition, the perimeter of the collar 475 of the pressure sleeve 471 can be larger than the perimeter of the portion 404 of the inner surface 480 of the tool 401, so that the collar 475 can abut against the rear face 412 of the tool 401 and prevent the body 474 from sliding too far inside of the cavity 420 of the tool 401.

In certain example embodiments, each wire 442 includes a conductor (not shown) that is encased by insulation 444. As shown in FIG. 4, the wires 442 are connected (mechanically coupled) to the wire receivers (not shown) of the connector end 470. In such a case, when the connector end 470 is mechanically coupled to the connector installation tool 401, as shown, the wires 442 can extend through the opening 430 that traverses the length of the tool 401. When this occurs, the wires 442 are out of the way when the compression device (not shown) is used to mechanically couple the connector end 470 to the other connector end (not shown) using the connector installation tool 401. Thus, the wires 442 can avoid being pinched or otherwise damaged, and the wires 442 can remain mechanically coupled to the wire receivers of the connector end 470.

FIG. 5 shows a cross-sectional side view of a system 500 for decoupling the electrical connector 290 of FIG. 2 from the example connector installation tool 100 of FIG. 1 in accordance with certain example embodiments. In one or more embodiments, one or more of the components shown in FIG. 5 may be omitted, added, repeated, and/or substituted. Accordingly, embodiments of a system for decoupling an electrical connector from a connector installation tool should not be considered limited to the specific arrangements of components shown in FIG. 5.

Referring to FIGS. 1-5, the system 500 of FIG. 5 is substantially the same as the system 300 of FIGS. 3A and 3B, except as described below. In this case, the second end 260 and the first end 270 of the connector 290 are already fully mechanically coupled to each other, as in FIG. 3B. In order to decouple (disassemble) the connector 290 from the connector installation tool 100 without damaging any exposed pins on the second end 260 of the connector 290, a removal tool 550 can be used.

In certain example embodiments, the removal tool 550 has a body 552 that forms a cavity 558 that leads to an open end. The body 552 is shaped and sized to fit within the rear face 285 of the second end 260 of the connector 290. In such a case, the cavity 558 is sized and shaped to house the wire receivers 292 of the second end 260. Thus, the removal tool 550 protects the wire receivers 292 when the connector 290 is extracted from the connector installation tool 100. The removal tool 550 can be removably coupled to the second end 260 with or without the use of a coupling feature on the removal tool 550 and/or the second end 260. Such coupling features can include, but are not limited to, mating threads, compression fittings, tabs, recesses, notches, and slots. The removal tool 550 can be made from one or more of a number of different materials, including but not limited to rubber, plastic, and metal.

In addition, the connector installation tool 100 has a portion 104 of the inner surface that has a shape and perimeter that is substantially similar to (or slightly larger than) the shape and perimeter of the outer surface of the flange 281 of the second end 260 of the connector 290, and yet also smaller than the shape and perimeter of the collar 283 of the second end 260 of the connector 290. In this case, the connector installation tool 201 can be used to remove the connector 290 by turning the connector installation tool 201 around so that first end 270 of the connector is disposed within the cavity 220 formed by portion 104 of the inner surface 180. Because the perimeter of the portion 104 is greater than the perimeter of the outer surface of the flange 281, more of the connector 290 can be disposed within the cavity 120. In this case, the rear face 112 can abut against the collar 283 of the second end 260.

With the removal tool 550 coupled to the second end 260 of the connector 290, the connector 290 can safely be removed (decoupled) from the connector installation tool 100 without damaging the wire receivers 292 and/or other components of the second end 260. The connector 290 can be removed from the connector installation tool 100 by hand, using a compression device (e.g., compression device 310), or using some other device.

Figure 6:
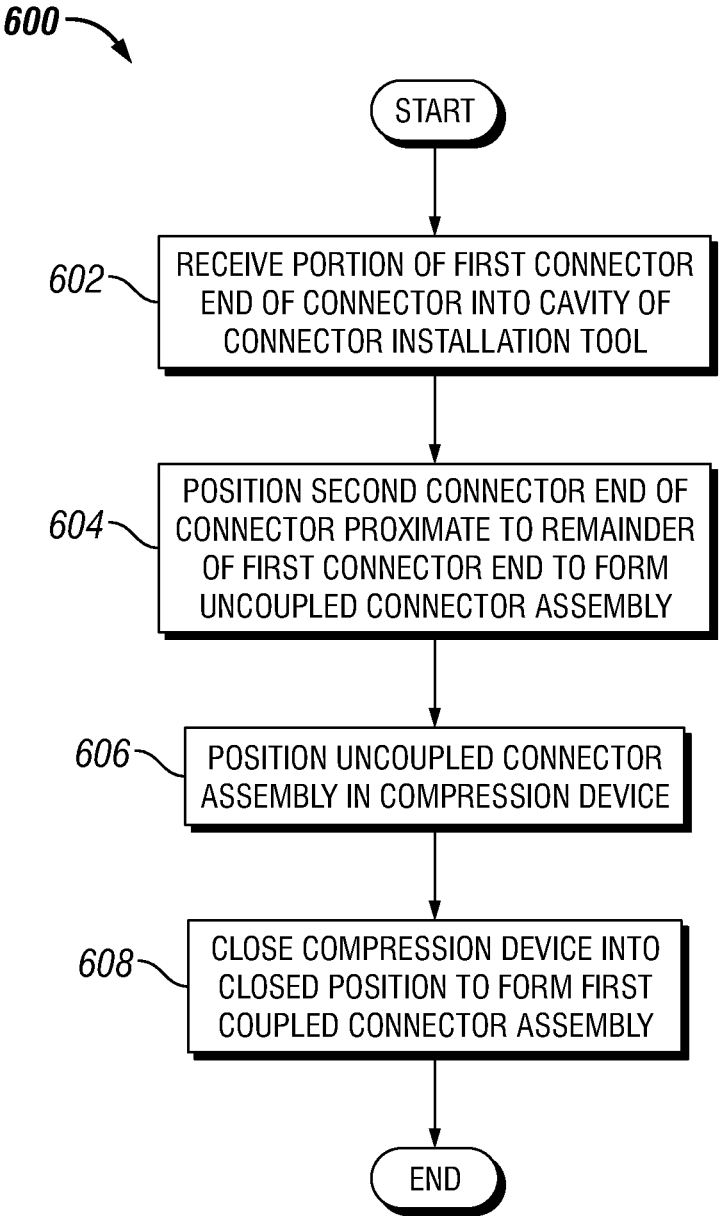
FIG. 6 shows a flow chart of a method for coupling two ends of a connector using an example connector installation tool in accordance with certain example embodiments.

FIG. 6 is a flow chart presenting a method 600 for coupling two ends of a connector using an example connector installation tool in accordance with certain example embodiments. While the various steps in this flowchart are presented and described sequentially, one of ordinary skill will appreciate that some or all of the steps may be executed in different orders, may be combined or omitted, and some or all of the steps may be executed in parallel. Further, in one or more of the example embodiments, one or more of the steps described below may be omitted, repeated, and/or performed in a different order. In addition, a person of ordinary skill in the art will appreciate that additional steps not shown in FIG. 6 may be included in performing this method. Accordingly, the specific arrangement of steps should not be construed as limiting the scope.

Referring now to FIGS. 1-6, the example method 600 begins at the START step and proceeds to step 602, where a portion of a first connector end 270 (or, more simply, the first end 270) of the connector 290 is received into a cavity 220 of a connector installation tool 201. In certain example embodiments, the portion of the first end 270 of the connector 290 that is received into the cavity 220 includes the sleeve 276 of the insert 272 and the body 274 of the pressure sleeve 271. The remainder (e.g., the collar 275 of the pressure sleeve 271, the collar 278 of the insert 272) of the first end 270 is positioned outside of the cavity 220. One of those remainder portions (e.g., the collar 275 of the pressure sleeve 271) can abut against a face (e.g., front face 211) of the connector installation tool 201. In certain example embodiments, at least one wire 542 that is coupled to the first connector end 270 (and, more specifically, to at least one wire receiver 296 of the first connector end 270) extends through an opening 230 that runs along a length of the connector installation tool 201.

In step 604, a second connector end 260 of the connector 290 is positioned proximate to the remainder of first connector end 270 to form an uncoupled connector assembly. In certain example embodiments, a first coupling feature 273 of the first connector end 270 is positioned proximately to a second coupling feature 294 of the second connector end 260. In some cases, a portion of the second connector end 260 can be disposed inside a cavity of an additional connector installation tool.

In step 606, the uncoupled connector assembly is positioned in a compression device 310. In such a case, the compression device 310 is in an open position. In step 608, the compression device 310 is closed into a closed position to form a first coupled connector assembly. In certain example embodiments, closing the compression device 310 couples the first coupling feature 273 of the first end 270 to the second coupling feature 294 of the second end 260. After step 608 is complete, the process can proceed to the END step.

Alternatively, once step 608 is complete, other steps can be performed. For example, the compression device 310 can be opened, and the components of the first coupled connector assembly (e.g., the first end 270, the second end 260, the connector installation tool 201, the additional connector installation tool) can be removed from the compression device 310. Once the first coupled connector assembly is removed from the compression device 310, the connector installation tool 201 (and, if applicable, the additional connector installation tool) can be decoupled from the connector to leave the connector 290, where the first end 270 and the second end 260 can remain mechanically coupled to each other. In such a case, one or more removal tools 550 can be used to help protect the wire receivers (e.g., wire receivers 292) and/or other components of the connector 290 while the connector 290 is decoupled from the connector installation tool 201. The connector 290 can be removed from the connector installation tool 201 by hand, using a compression device (e.g., compression device 310), or using some other device.

In certain example embodiments, when decoupling the connector 290 from the connector installation tool 201, the orientation of the connector installation tool 201 can be reversed. In other words, the first connector end 270 of the connector 290 can be disposed within the cavity 220 formed by the portion 207 and the portion 204, rather than the portion 206. The wires 242 can extend through the opening 230, and a portion (e.g., the collar 283 of the insert 272) of the second end 260 of the connector 290 can abut against the rear face 212 of the connector installation tool 201.

Using example connector installation tools described herein increases the ease of wiring one or both ends of a connector and coupling the ends of the connector to each other. Further, using example connector installation tools reduces the likelihood of causing damage to one or more components (e.g., a wire, a wire receiver, a coupling feature) of the connector as the ends of the connector are coupled to each other. While example embodiments shown herein are for connectors that receive multiple (e.g., 150, 100) wires at one or both ends, example embodiments can also be used for connectors with ends that each receive a single wire.

Further, an example removal tool 550 can be used while coupling connector ends using example connector installation tools and/or while removing a connector from a connector installation tool. In such a case, various components (e.g., wire receivers) of a connector end can be protected from damage while coupling connector ends using example connector installation tools and/or while removing a connector from a connector installation tool.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A system for assembling an electrical connector, comprising:

a connector installation tool comprising:

an inner surface that forms a cavity that traverses a length of the connector installation tool, wherein the inner surface comprises a first portion that receives a first proximal end of a first connector end;

a front face located adjacent to and substantially perpendicular to the first portion of the inner surface, wherein the front face abuts against a protrusion of the first connector end; and a rear face located adjacent to a distal end of the inner surface, wherein the rear face is substantially parallel to the front face; and a compression device comprising a first wall and a second wall, wherein the rear face of the connector installation tool abuts against the first wall of the compression device, and wherein the second wall of the compression device abuts against a second proximal end of a second connector end of the electrical connector, wherein the first connector end and the second connector end are decoupled from each other when the compression device is in a first position prior to moving to a second position, and wherein a first distal end of the first connector end and a second distal end of the second connector end are coupled to each other when the compression device is in the second position.

2. The system of claim 1, further comprising:

at least one wire that mechanically couples to at least one wire receiver of the first connector end, wherein the at least one wire traverses an opening of the connector installation tool, wherein the opening traverses the length of the connector installation tool.

3. The system of claim 1, wherein the first portion of the inner surface has a first perimeter, wherein the inner surface further comprises a second portion having a second perimeter, wherein the rear face is adjacent to the second portion of the inner surface, wherein the second portion of the inner surface is configured to receive a third proximal end of a third connector end of a second electrical connector as an alternative to the first electrical connector, wherein the rear face is configured to abut against a protrusion of the third connector end instead of the first wall of the compression device when the third proximal end is disposed in the cavity, wherein the front face is configured to abut against the second wall of the compression device when the first connector end is disengaged from the first portion of the inner surface, wherein the third connector end comprises a third coupling feature located opposite the third proximal end, wherein the third coupling feature of the third connector end is configured to couple to a fourth coupling feature of a fourth connector end of the second electrical connector, wherein the fourth coupling feature is coupled to the third coupling feature when the first wall of the compression device applies the compressive force against a fourth proximal end the fourth connector end as the second wall moves toward the second position relative to the first wall of the compression device.

4. The system of claim 3, wherein the second perimeter of the second portion of the inner surface has a second size and a second shape that is substantially the same as those of the third connector end of the second electrical connector, wherein the third proximal end of the third connector end comprises at least one wire receiver.

5. The system of claim 3, wherein the inner surface further comprises a third portion having a third perimeter that is greater than the first perimeter and less than the second perimeter, wherein the third portion is positioned between the first portion and the second portion of the inner surface.

6. The system of claim 5, wherein the second perimeter and the third perimeter of the second portion of the inner surface has a third size and a third shape that is substantially the same as those of the second connector end of the electrical connector.

7. The system of claim 1, further comprising:

a removal tool that removably couples to the second connector end of the electrical connector.

8. The system of claim 7, wherein the removal tool comprises a recessed feature into which at least one wire receiver of the second connector end is disposed when the removal tool is coupled to the second connector end.

9. The system of claim 1, wherein the first connector end of the electrical connector comprises a first coupling feature, a protrusion on its outer surface, and a first proximal end comprising at least one first wire receiver, wherein the protrusion is disposed between the first coupling feature and the first proximal end, wherein the second connector end of the electrical connector comprises a second coupling feature and a second proximal end comprising at least one second wire receiver, wherein the second coupling feature mechanically couples to the first coupling feature.

* * * * *